US005836854A

United States Patent [19]

Kuo

[11] Patent Number: 5,836,854

[45] Date of Patent: Nov. 17, 1998

[54] ROAMING EXCERCISER

[76] Inventor: Hai Pin Kuo, Chi-Lu-Chien No. 30, Pao-An Tsun, Jen-Te Hsiang, Tai-Nan Hsien, Taiwan

[21] Appl. No.: 21,487

[22] Filed: Feb. 10, 1998

[51] Int. Cl.[6] ..... A63B 69/16; A63B 22/04

[52] U.S. Cl. ..... 482/52; 482/57; 482/70

[58] Field of Search ..... 482/51, 52, 53, 482/57, 70, 79, 80, 54, 71, 74, 92, 62; D21/191

[56] References Cited

U.S. PATENT DOCUMENTS

| | | | |
|---|---|---|---|
| D. 372,282 | 7/1996 | Pasero et al. | D21/191 |
| 5,518,473 | 5/1996 | Miller | 482/51 |
| 5,529,555 | 6/1996 | Rodgers | 482/57 |
| 5,573,480 | 11/1996 | Rodgers | 482/57 |
| 5,593,372 | 1/1997 | Rodgers | 482/70 |
| 5,653,662 | 8/1997 | Rodgers | 482/52 |

*Primary Examiner*—Stephen R. Crow
*Attorney, Agent, or Firm*—Rosenberg, Klein & Bilker

[57] ABSTRACT

A roaming exerciser includes a base having a bracket on which is mounted a resistance wheel, a vertical post fixedly installed on the base, a handle grip mounted on the post, a driven wheel connected to the resistance wheel via an endless belt, a pair of cranks connected to the driven wheel, a Z-shaped link having a lower end pivotally connected with an intermediate portion of the base, a pair of first and second oscillating links pivotally connected to an upper portion of the Z-shaped link, a pair of intermediate links pivotally connected to the first and second oscillating links, and a pair of pedal links pivotally connected to the intermediate links at one end and pivotally connected to the cranks at another end, whereby an user can have exercise in a smooth and natural action.

3 Claims, 8 Drawing Sheets

ROAMING EXCERCISER

FIELD OF THE INVENTION

This invention is related to a roaming exerciser and in particular to one which enables an individual to exercise a number of different muscles through a large range of motion in a smooth and natural manner.

DESCRIPTION OF THE PRIOR ART

A number of exercise devices have been designed and developed to enable people to take exercise indoors. Examples of the most popular exercise devices are treadmills for simulating walking and jogging, stationary bicycles for simulating riding bicycles, and rowing exercisers for simulating rowing boats. However, all of the devices suffer from a lot of drawbacks which result in the limition of their utility.

Therefore, it is an object of the present invention to provide a roaming exerciser which enables one to exercise a number of different muscles through a large range of motion in a smooth and natural manner.

SUMMARY OF THE INVENTION

This invention is related to an improved roaming exerciser.

It is the primary object of the present invention to provide a roaming exerciser which enables an individual to exercise muscles at relatively large range of motion.

It is another object of the present invention to provide a roaming exerciser which enables an individual's feet to move along a smooth elliptical path during exercise.

It is still another object of the present invention to provide a roaming exerciser which enables an individual to take exercise in a smooth and natural action.

It is still another object of the present invention to provide a roaming exerciser which will not cause injury to an individual's feet in exercise.

It is a further object of the present invention to provide a roaming exerciser which can be produced in a simple and convenient manner.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
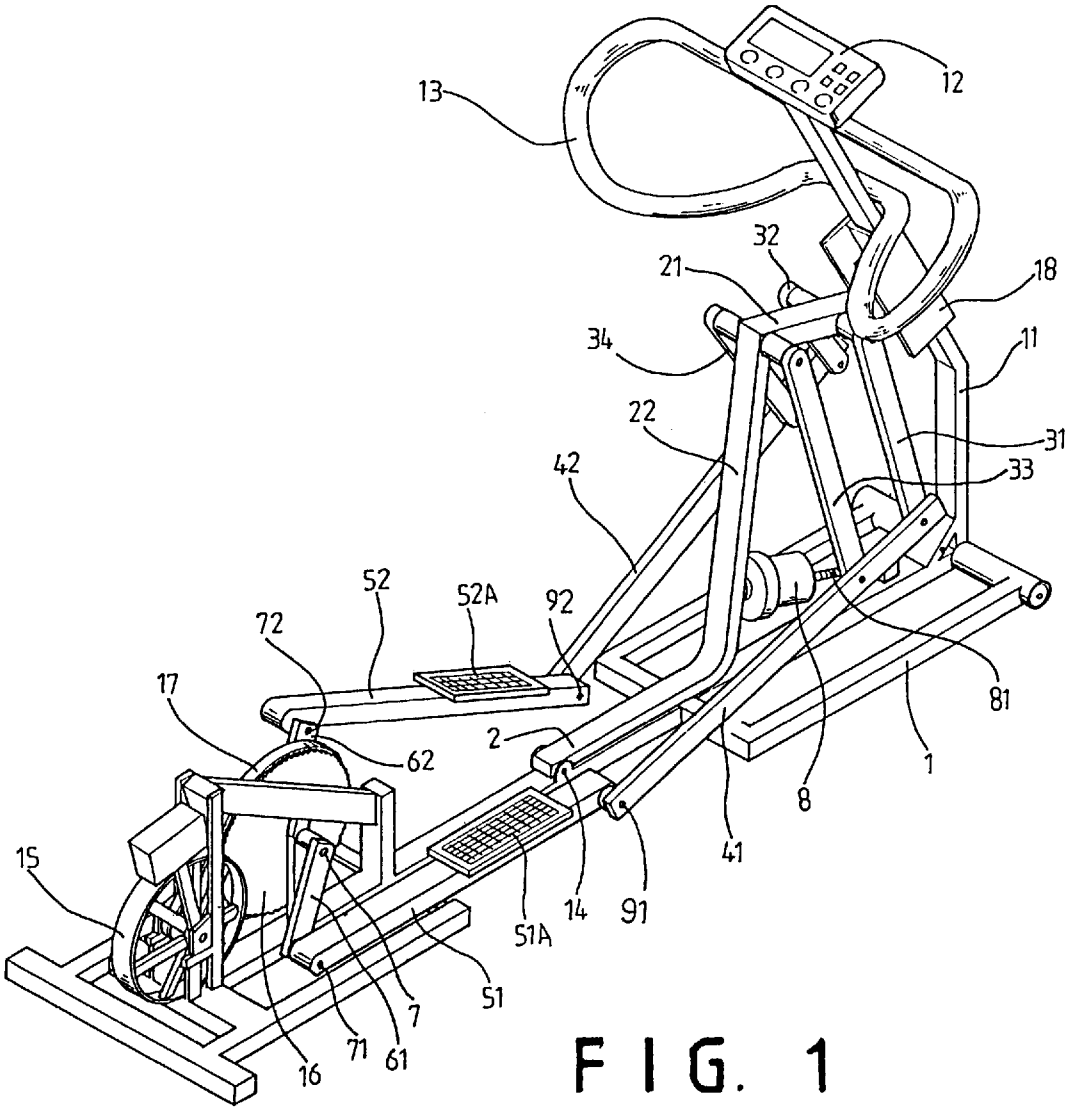
FIG. 1 is a perspective view of a roaming exerciser according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
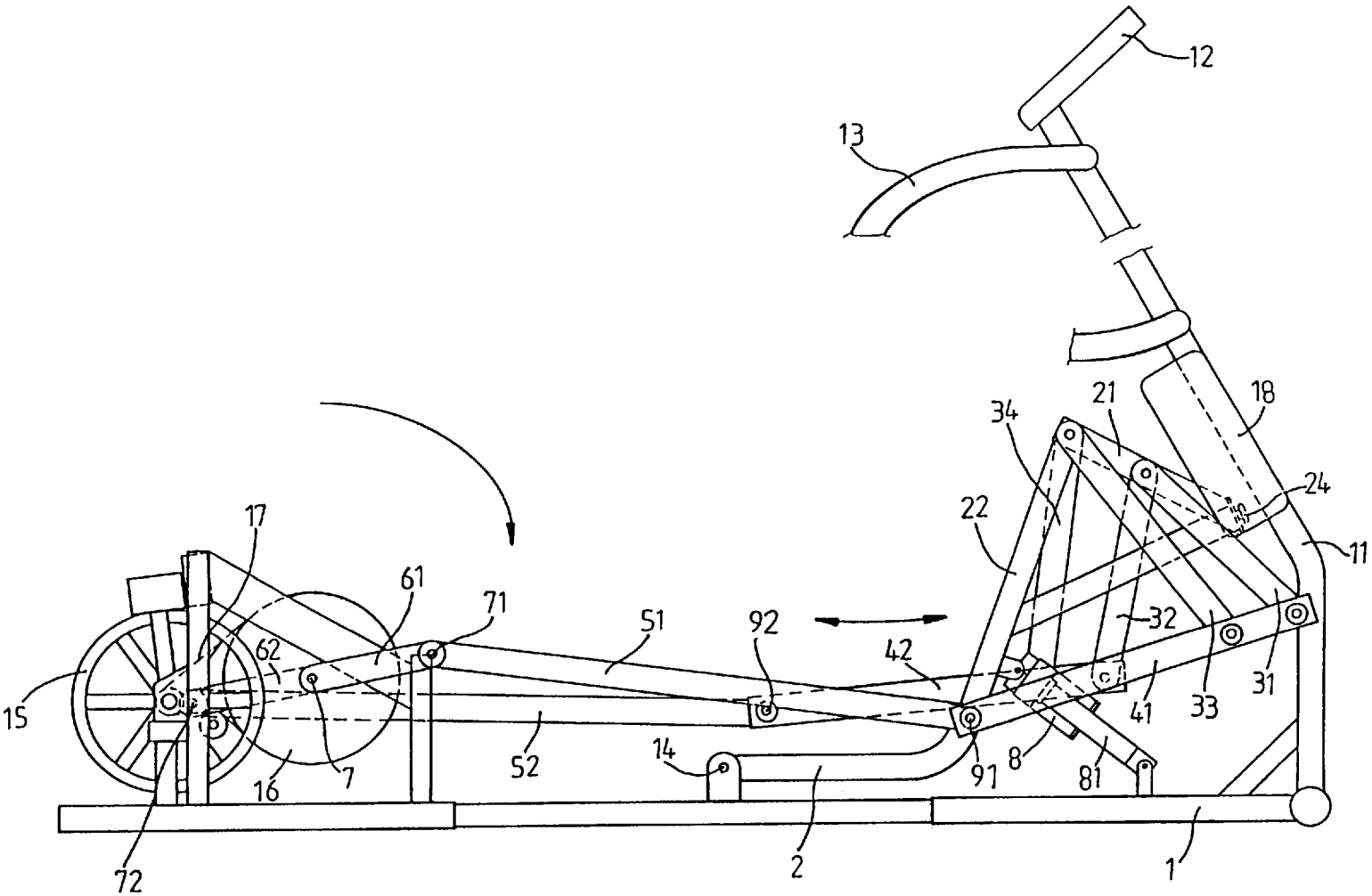
FIG. 2 is a side elevational view of the roaming exerciser.

With reference to the drawings and in particular to FIGS. 1 and 2 thereof, the roaming exerciser according to the present invention essentially comprises a base 1, a vertical post 11 fixedly mounted on the front end of the base 1, a control panel 12 arranged on the top of the post 11 for monitoring an individual's workout and provide an output display indicating various conditions such as time, speed and distance, and a handle grip 13 installed on the upper portion of the post 11.

The intermediate portion of the base 1 is pivotally connected to a lower end of a primary link 2 by a pin 14. The upper portion of the primary link 2 is pivotally connected to a first pair of oscillating links 31 and 32 and a second pair of oscillating links 33 and 34. The oscillating links 31, 32, 33 and 34 are of different lengths.

The other ends of the oscillating links 31, 33, 32 and 34 are pivotally connected to an end of intermediate links 41 and an end of intermediate links 42, respectively. The other ends of the intermediate links 41 and 42 are respectively connected to the end of pedal links 51 and 52 by pivot pins 91 and 92. The other ends of the pedal links 51 and 52 are pivotally connected to the outer ends of cranks 61 and 62 by pins 71 and 72. The pedal links 51 and 52 are provided with pads 51A and 52A.

Figure 4:
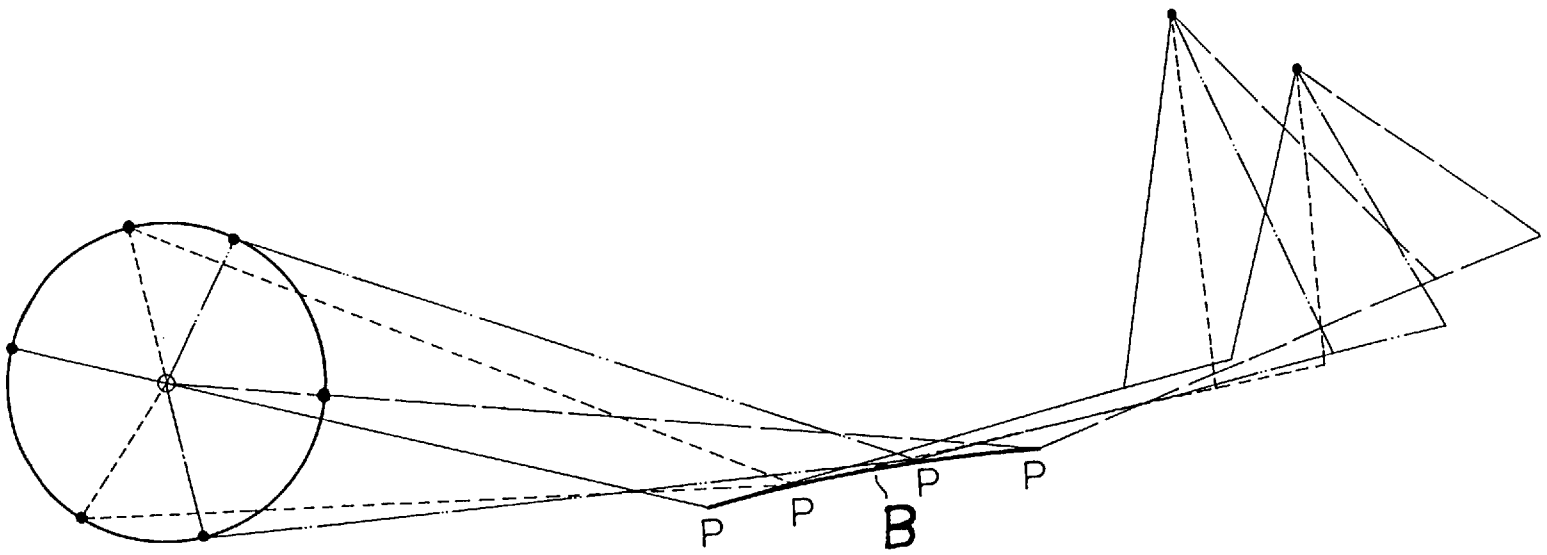
FIG. 4 illustrates how the point P moves approximately along a straight line.
Figure 5:
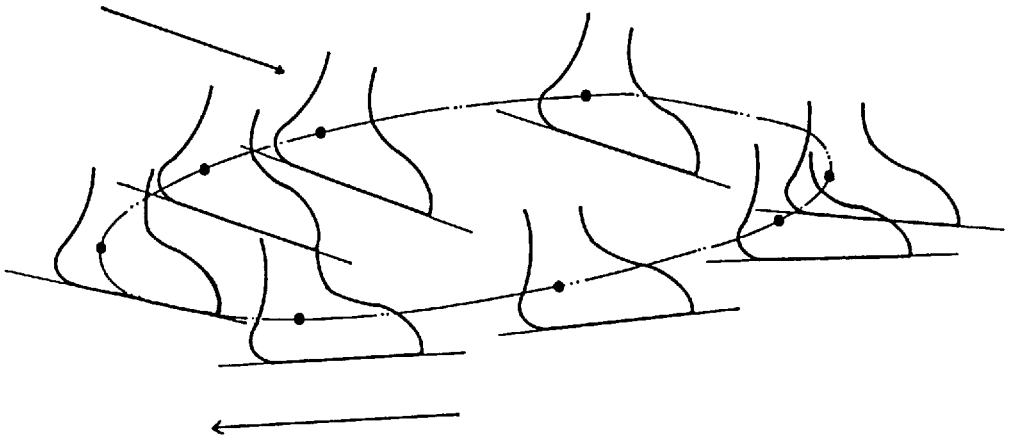
FIG. 5 illustrates how the foot is exercised.

The rear portion of the base 1 is provided with a bracket (shown but not numbered) on which is mounted a resistance wheel 15. The resistance wheel 15 is connected to a driven wheel 17 by a belt 17 and has an axle 7 fixedly connected with the inner ends of the cranks 61 and 62. As a user stands on the pads 51A and 52A of the pedal links 51 and 52 and move his feet to and fro, the pedal links 51 and 52 will move the first and second pairs of oscillating links 31, 33, 32 and 34 to move in an opposite direction by means of the intermediate links 41 and 42. The first pair of the oscillating links 31 and 32, the second pair of the oscillating links 33 and 34, and the intermediate links 41 and 42 form a Watt Straight-Line Mechanism and are so arranged as to guide a point P locating on the pivot pins 91 and 92 to move approximately along a straight line (see line B of FIG. 4). When the point P moves along a straight line, the pads 51A and 52A on the pedal links 51 and 52 will move along an elliptical path (see FIG. 3). As a consequence, the Achilles' tendon, the ankle point, the heel, the arch and the medial malleolus of the feet will be comfortably exercised when the sole is moved in unison with the pads 51A and 52A (see FIG. 5). Further, the inertia of the first and second pairs of oscillating links 31, 33, 32 and 34 will prevent the dead points of the pedal links 51 and 52 thereby preventing the foot from being injured.

Figure 3:
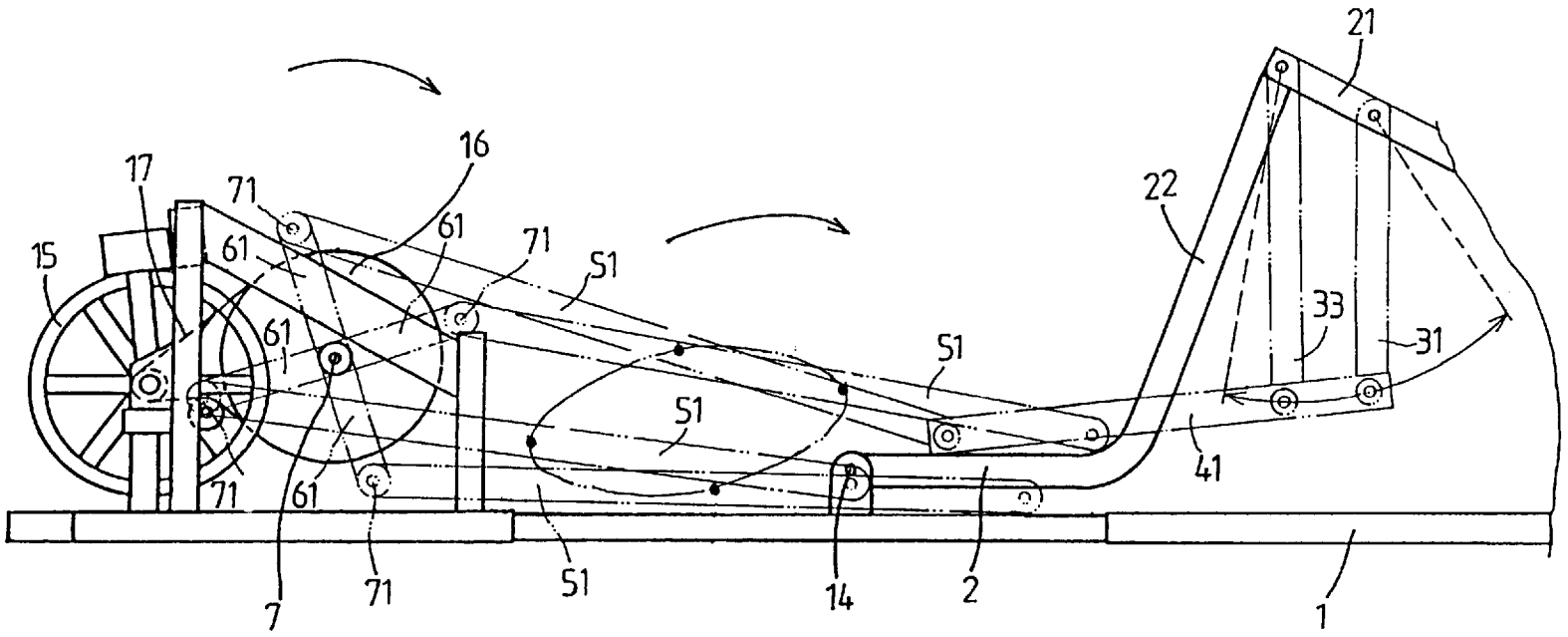
FIG. 3 illustrates the travelling path of the pedal links.
Figure 6:
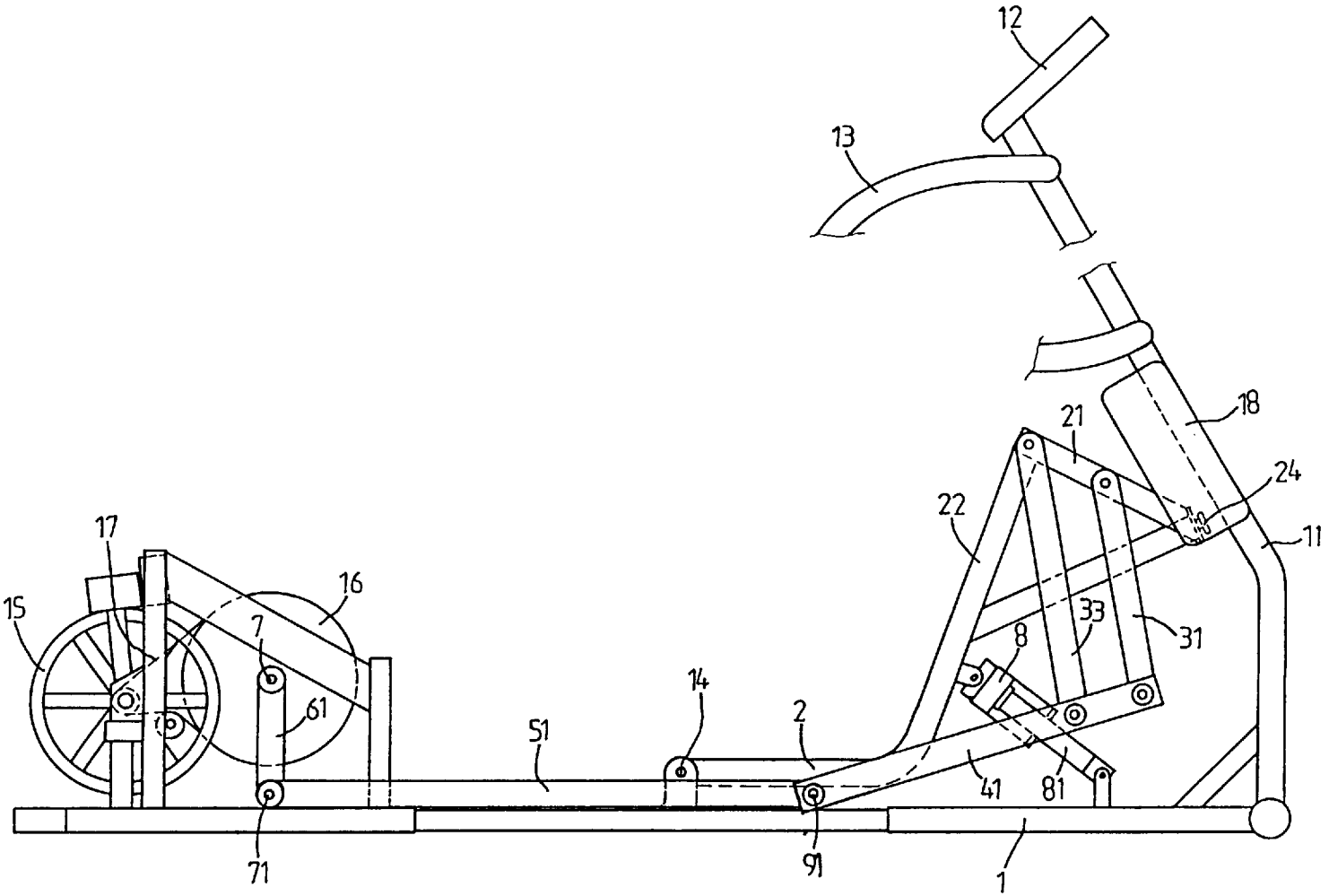
FIG. 6 is a side elevational view illustrating the lowest position of the primary link.
Figure 7:
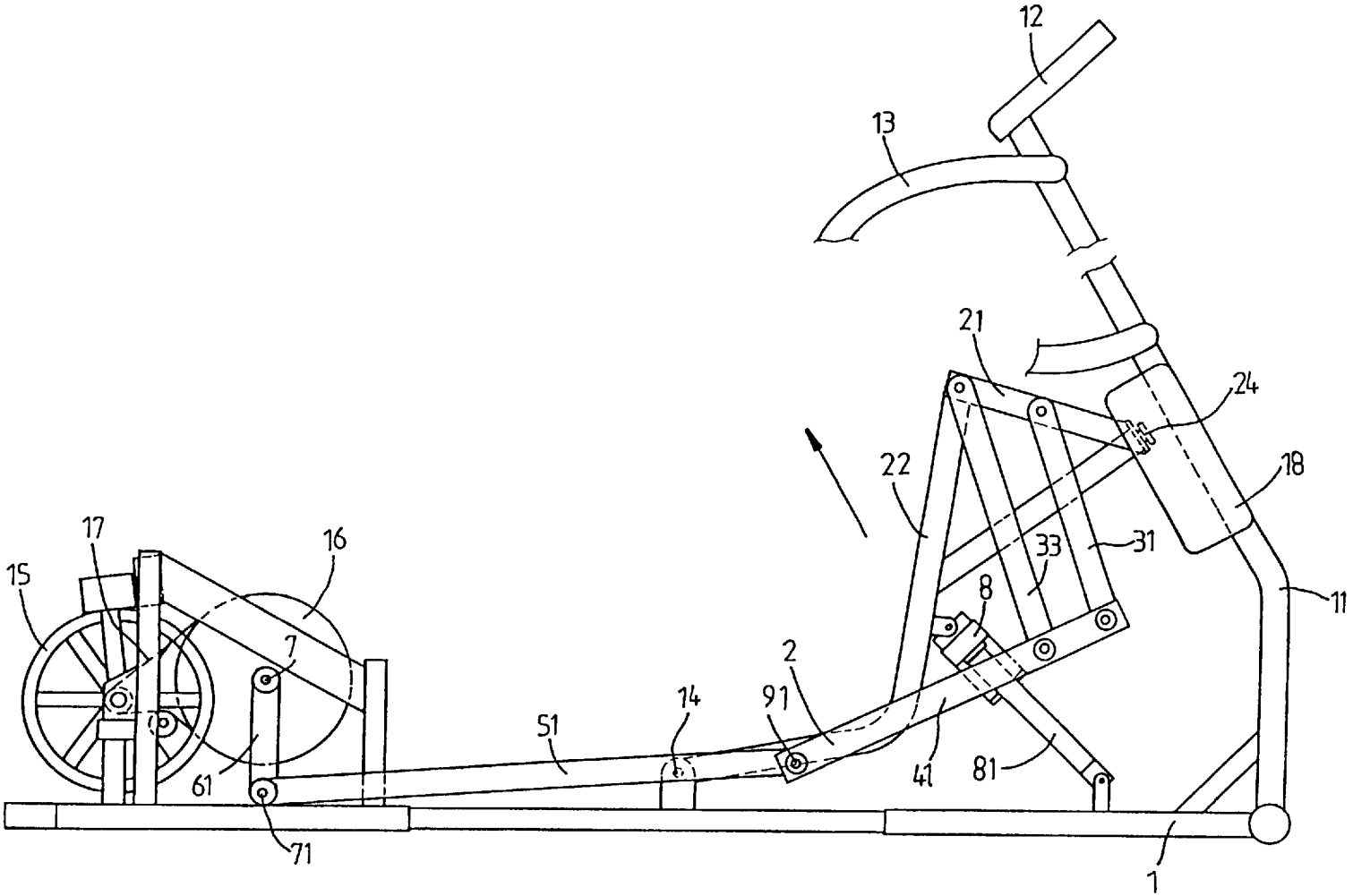
FIG. 7 is a side elevational view illustrating the highest position of the primary link.
Figure 8:
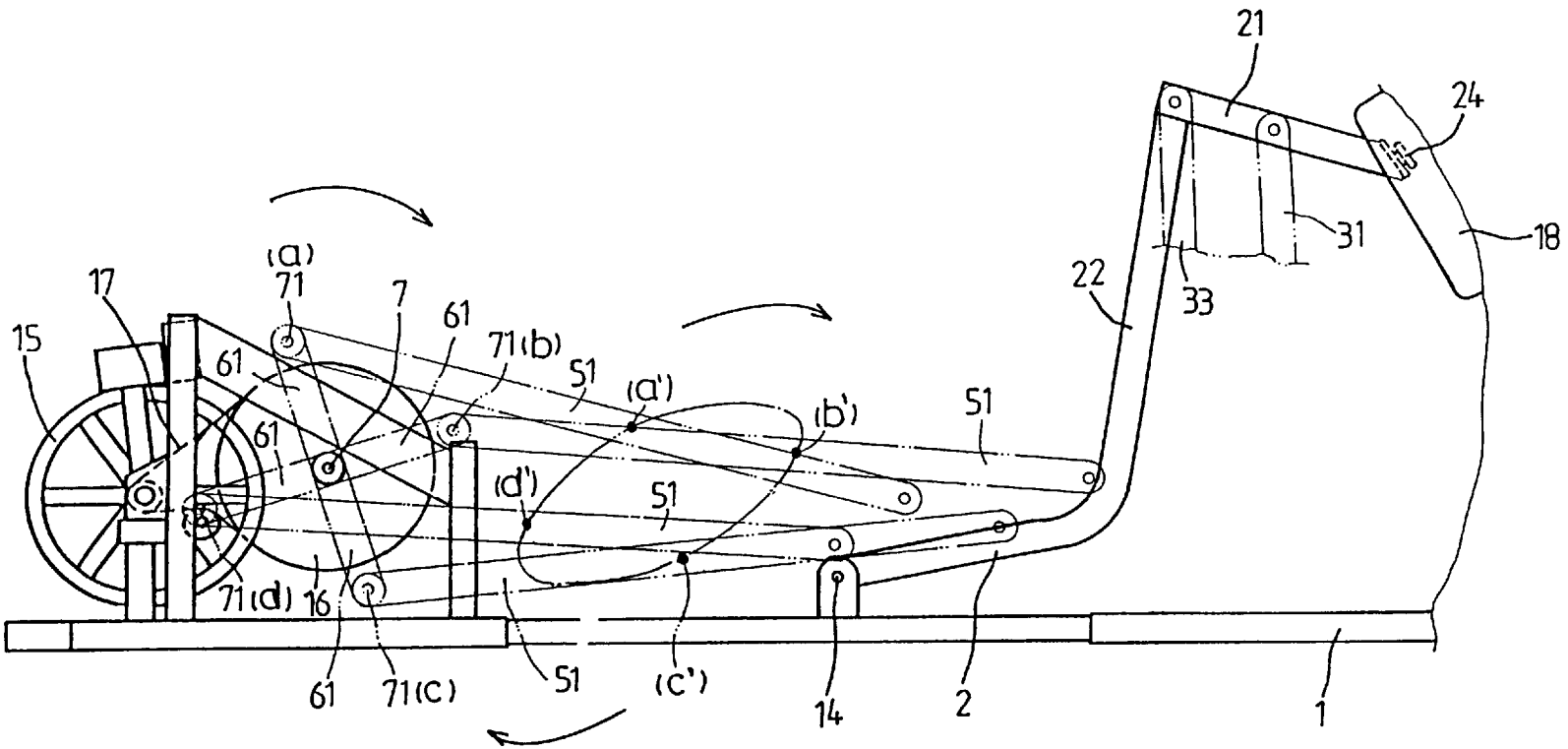
FIG. 8 illustrates the travelling path of the pedal links when the primary link is at the highest position.

Referring to FIGS. 6 and 7, a mounting 8 is pivotally arranged on the intermediate portion of the primary link 2 for receiving an electric motor which has a telescopic axle 81 pivotally connected to the front portion of the base 1. As the electric motor is turned on to extend the telescopic axle 81 out thereof, the intermediate portion of the primary link 2 will be moved upwardly thereby moving the positions of the first and second pairs of oscillating links 31, 33, 32 and 34, the intermediate links 41 and 42, and the pedal links 51 and 52 and therefore adjusting the inclination of the pivot pins 91 and 92 with respect to the pivot pins 71 and 72. The inclination of the pivot pins 91 relative to the pivot pins 71 and 72 can be adjusted to raise or lower the pedal links to the desired position. The electric motor is controlled by a microprocessor, which is well known in the art and not considered a part of the invention. The travelling path of the pedal links 51 and 52 is shown in FIG. 8, which is slightly different from that as shown in FIG. 3. The outer end of the upper portion of the primary link 2 is provided with two rollers 24 (only one is shown in the drawings). The rollers 24 are in contact with two inner sides of a U-shaped block 18 which is fixedly mounted on the post 11 so that the primary link 2 can be smoothly and steadily adjusted in position.

In conclusion, the roaming exerciser according to the present invention is characterized in that an individual's feet can be kept moving approximately along a straight while travelling along an elliptical path in exercise, thereby enabling the individual to exercise a number of different muscles through a large range of motion in a smooth and natural manner.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A roaming exerciser comprising:

a base having a bracket on which is mounted a resistance wheel;

a vertical post fixedly installed on said base;

a handle grip mounted on said post;

a driven wheel connected to said resistance wheel via an endless belt and provided with an axle;

a pair of cranks each having an end mounted on a respective end of said axle of driven wheel;

a Z-shaped link having a lower end pivotally connected with an intermediate portion of said base;

a pair of first oscillating links with different lengths having an end pivotally connected to an upper portion of said Z-shaped link;

a pair of second oscillating links with different lengths having an end pivotally connected to an upper portion of said Z-shaped link;

a pair of intermediate links having an end pivotally connected to another respective end of said first and second oscillating links; and a pair of pedal links each having a first end pivotally connected to a respective end of said intermediate links and having a second end pivotally connected to another end of a respective one of said cranks.

2. The roaming exerciser as claimed in claim 1, wherein said post has a U-shaped block and an outer end of said upper portion of said Z-shaped link is provided with roller means slidably engaged with inner sides of said U-shaped block.

3. The roaming exerciser as claimed in claim 1, wherein said Z-shaped link is provided with an electric motor which has a telescopic axle having an end pivotally connected with said base.

* * * * *